US011028545B2

(12) United States Patent
Powell et al.

(10) Patent No.: US 11,028,545 B2
(45) Date of Patent: Jun. 8, 2021

(54) MOBILE TRAFFIC BARRIER

(71) Applicant: Vandorf MB1 Inc., Stouffville (CA)

(72) Inventors: Benjamin Fraser Powell, King City (CA); Dean Clinton Alberson, Bryan, TX (US); Mohammad Talha Ghuman, Oakville (CA)

(73) Assignee: Vandorf MB 1 Inc.

( * ) Notice: Subject to any disclaimer, the term of this patent is extended or adjusted under 35 U.S.C. 154(b) by 72 days.

(21) Appl. No.: 16/595,323

(22) Filed: Oct. 7, 2019

(65) Prior Publication Data

US 2020/0109531 A1 Apr. 9, 2020

Related U.S. Application Data

(60) Provisional application No. 62/741,602, filed on Oct. 5, 2018.

(51) Int. Cl.

| | |
|---|---|
| ***E01F 15/00*** | (2006.01) |
| ***E01F 13/02*** | (2006.01) |
| ***E01F 15/08*** | (2006.01) |

(52) U.S. Cl.

CPC ..... *E01F 15/006* (2013.01); *E01F 13/02* (2013.01); *E01F 15/088* (2013.01)

(58) Field of Classification Search

CPC ..... E01F 13/02; E01F 15/006; E01F 15/088
USPC ..... 404/6; 256/13.1
See application file for complete search history.

(56) References Cited

U.S. PATENT DOCUMENTS

| | | | | |
|---|---|---|---|---|
| 4,681,302 | A | 7/1987 | Thompson | |
| 4,806,044 | A | 2/1989 | Duckett | |
| 4,828,425 | A | 5/1989 | Duckett | |
| 5,208,585 | A | 5/1993 | Sprague | |
| 5,246,305 | A * | 9/1993 | Peek | E01F 15/006 404/6 |
| 5,605,413 | A | 2/1997 | Brown | |
| 6,059,491 | A | 5/2000 | Striefel et al. | |
| 6,203,242 | B1 | 3/2001 | Englund | |
| 6,413,009 | B1 | 7/2002 | Duckett | |
| 6,439,802 | B1 * | 8/2002 | Duckett | E01F 15/088 404/6 |
| 6,474,904 | B1 | 11/2002 | Duckett et al. | |

(Continued)

FOREIGN PATENT DOCUMENTS

| | | | |
|---|---|---|---|
| AU | 2010101365 | A4 | 1/2011 |
| CA | 1232784 | A | 2/1988 |

(Continued)

*Primary Examiner* — Raymond W Addie
(74) *Attorney, Agent, or Firm* — John G. Fischer, Esq.; Scheef & Stone, L.L.P.

(57) ABSTRACT

A traffic barrier system of series connectable barriers, each barrier having a body with a skirt section, an intermediate section comprising a lower portion, a central portion, and an upper portion, and a head section extending above the intermediate section. The skirt section and lower portion have positive slopes. The upper portion and head section have negative slopes. A vertical end channel is formed on each of the opposite first and second ends. A lower tension bar is cast in the skirt section and an upper tension bar is cast in the head section. Within the body of the barrier, the tension bars are articulated in relation to each other. The tension bars have tabs extending out of the body for overlapping pivotal connection to an adjacent barrier.

29 Claims, 15 Drawing Sheets

(56) References Cited

U.S. PATENT DOCUMENTS

| | | | | |
|---|---|---|---|---|
| 6,669,402 | B1 | 12/2003 | Davis et al. | |
| 7,234,275 | B1 | 6/2007 | Haggy et al. | |
| 7,416,364 | B2 | 8/2008 | Yodock, III et al. | |
| 7,708,492 | B2 * | 5/2010 | Carey | E01F 15/088 404/6 |
| 8,172,204 | B2 * | 5/2012 | Serafin | E01F 15/085 256/13.1 |
| 8,545,126 | B1 | 10/2013 | Alsaffar | |
| 9,127,424 | B2 | 9/2015 | James et al. | |
| 10,101,132 | B2 | 10/2018 | Maydew | |
| 10,190,274 | B2 | 1/2019 | James et al. | |
| 10,544,555 | B1 * | 1/2020 | Lim | E01F 15/088 |
| 10,844,560 | B2 * | 11/2020 | Ramaekers | E01F 15/08 |
| 2003/0219308 | A1 | 11/2003 | Boulais et al. | |
| 2009/0035060 | A1 * | 2/2009 | Volkmann | E01F 15/085 404/6 |
| 2014/0314479 | A1 * | 10/2014 | Stephens | E01F 15/086 404/6 |
| 2019/0330813 | A1 * | 10/2019 | Ramaekers | E01F 15/085 |

FOREIGN PATENT DOCUMENTS

| | | | |
|---|---|---|---|
| CA | 2915899 | A1 | 1/2015 |
| CN | 206768681 | U | 12/2017 |
| DE | 8807985 | U1 | 9/1988 |
| EP | 1162315 | A1 | 12/2001 |

* cited by examiner

MOBILE TRAFFIC BARRIER

RELATED APPLICATION

This application claims the benefit of U.S. Provisional Application No. 62/741,602 filed Oct. 5, 2018, the disclosure of which is hereby incorporated herein by reference in its entirety.

FIELD OF THE DISCLOSURE

This disclosure relates to a mobile barrier for controlling vehicle access to a traffic or roadway lane during construction, emergencies or traffic congestion mitigation operations.

BACKGROUND

Current traffic barriers, such as barriers that may be moved with a traffic barrier moving vehicle system, are such that manufacturers design the barriers specific to their vehicle configurations. These barriers are not usable on third party vehicles. Another disadvantage of current traffic barrier designs is that the barrier profiles are such that upon impact by a vehicle, they provide inadequate resistance to underride, override, uncontrolled deflection and unacceptable damage to the passenger compartment. Another disadvantage of current traffic barrier designs is that the barrier profiles are such that vehicle stability is often compromised, and in some instances the traffic barrier shapes have a negative effect on both vehicular integrity and occupant safety during impact of the vehicle with the traffic barrier.

Another disadvantage of current traffic barrier designs is that they often rely on conventional rebar assemblies to protect the barrier from structural failure when the barriers are series connected and subject to high tensile stress from direct impacts and from in-line impacts to adjacent barriers. Another disadvantage of current traffic barrier designs is that those having pivotal connections do not provide sufficient resistance to the high torque imparted at those connections. Another disadvantage of current traffic barriers is that they rely on a transition of materials, such as from steel connectors to concrete and back to steel connectors to absorb and transfer tensile loads on impact.

There is a need for a mobile traffic barrier that is universally adapted to accommodate different traffic barrier moving vehicles. There is also a need for a mobile traffic barrier with profile and surface characteristics that improve vehicular stability and occupant safety during a collision of a vehicle with a traffic barrier. There is also a need for series connectable traffic barriers that withstand the higher impacts imparted by the larger SUVs and trucks that are increasing in number within the vehicle population.

An advantage of the embodiments of the present invention is that they provide mobile series connectable barriers that can be lifted and placed by a barrier moving machine. Another advantage of these embodiments is that they provide increased resistance to structural damage of non-impacted barriers that are connected to impacted barriers. Another advantage of these embodiments is that they provide improved resistence to underride, override, and uncontrolled deflection.

Another advantage of these embodiments is that they adequately limit damage to the passenger compartment. Another advantage of these embodiments is that they provide a reduced manufacturing cost option. Another advantage of these embodiments is that they provide a strategically designed capture zone for absorbing energy while preventing lift of the impacting vehicle.

In summary, the disclosed invention provides a unique solution to the engineering constraints and challenges of providing a mobile traffic barrier that safely and economically absorbs energy alone and in combination with series connected barriers of like design in a manner that overcomes the aforementioned disadvantages.

The advantages and features of the embodiments presently disclosed will become more readily understood from the following detailed description and appended claims when read in conjunction with the accompanying drawings in which like numerals represent like elements.

SUMMARY

For all purposes of this disclosure, the following definitions are adopted. The barrier vertical centerline is the reference used by which the barrier's profile slope angles are indicated. A slope has a direction running from its lowest vertical point to its highest vertical point. A positive slope is defined as a slope having a direction that runs inwards towards the vertical centerline. A negative slope is defined as a slope having a direction that runs outwards away from the vertical centerline. A neutral slope is defined as a slope that runs substantially vertically (not inwards or outwards) and is thus parallel to the vertical centerline.

A series connectable traffic barrier is disclosed. The barrier has a body comprising a skirt section, an intermediate section, and a head section. The skirt section extends upwards and has a positive slope. The intermediate section comprises a lower portion, a central portion, and an upper portion. The lower portion extends upwards from the skirt section and has a positive slope. The central portion extends upwards from the lower portion. The upper portion extends upwards from the central portion and has a negative slope. The head section is located above the upper portion and has a negative slope.

The lower portion of the intermediate section has a positive slope with an angle greater than the slope of the skirt. The head section has a negative slope with an angle less than the slope of the upper portion. The central portion may have a neutral slope.

The body has a first end and an opposite second end. A vertical end channel is formed on each of the first and second ends. In one embodiment, the body is made of cast concrete.

A lower tension bar made of steel or similar metal has a lower first tab on one end and a lower second tab on its opposite end. The lower tension bar is located within the skirt section. The lower first tab extends through the channel of the first end. The lower second tab extends through the channel of the second end.

An upper tension bar made of steel or similar metal has an upper first tab on one end and an upper second tab on its opposite end. The upper tension bar is located within the head section. The upper first tab extends through the channel of the first end. The upper second tab extends through the channel of the second end. The upper and lower first tabs are pivotally connectable to the upper and lower second tabs on an adjacent barrier.

In one embodiment, there is an aperture on each of the upper and lower first tabs and the upper and lower second tabs. The apertures of the upper tabs are in vertical alignment with the apertures of the lower tabs. In this embodiment, a pivot pin is insertable in the apertures of the upper and lower second tabs of one barrier and through the aligned apertures of the upper and lower first tabs on an adjacent barrier.

In one embodiment, the upper and lower second tabs of a first barrier section are locatable between the upper and lower first tabs on an adjacent barrier. A pivot pin is insertable through the apertures on the upper and lower second tabs of the first barrier section and the upper and lower first tabs of the adjacent barrier. In this configuration, the adjacent barriers can be readily lifted and placed by a barrier moving machine.

In one embodiment, the upper tension bar is inclined downwards inside the head section between the upper first tab and the upper second tab. The lower tension bar is oppositely inclined upwards inside the skirt between the lower first tab and the lower second tab. The upper first tab and upper second tab extend horizontally into the channels of the first end and second end, respectively. The lower first tab and lower second tab extend horizontally into the channels of the first end and second end, respectively. This permits horizontal alignment of the tab apertures between adjacent barrier sections.

In one embodiment, the body has a centerline along its length. The upper and lower tension bars are located on the centerline. In one embodiment, the width of the head section is within 2" of the width of the skirt section. This permits center of mass balance of the barrier, which, when combined with the connection of flat tabs of adjacent barriers, resists roll-over on impact.

In one embodiment, a pair of vertical chamfered edges is formed on each of the first end and second end of the body. The chamfered edges allow for an articulated connection between the two adjacent connected barrier sections.

In one embodiment, the chamfered edges intersect the head section and the skirt section. In one embodiment, the chamfered edges intersect the head section, the upper portion, the lower portion, and the the skirt section. In one embodiment, the chamfered edges are from about 10° to about 20°.

In one embodiment, a pair of top chamfers extend horizontally along the top of the head section from the first end to the second end of the body. In one embodiment, a pair of top chamfers extend horizontally along the top of the head section between the chamfered edges of the first end and the second end of the body.

In one embodiment, the skirt section has a positive slope angle to the centerline in the range of from about 6° to about 14°. In one embodiment, the lower portion of the intermediate section has a positive slope angle to the centerline in the range of from about 16° to about 24°. In one embodiment, the central portion of the intermediate section has a slope angle to the centerline in the range of from about −4° to about +4°. In one embodiment, the upper portion of the intermediate section has a negative slope angle to the centerline in the range of from about −16° to about −24°.

In one embodiment, the head section has a negative slope angle to the centerline in the range of from about −6° to about −14°. In one embodiment, a bottom channel extends along the bottom of the skirt from the channel of the first end to the channel of the second end.

In one embodiment, the bottom channel has a pair of side walls and a top wall. In one embodiment, the two side walls may range from having a negative slope angle to having a positive slope angle. The two side walls have a slope angle in the range of from about −5° to about −5° to the centerline.

In an alternative embodiment designed for use with highway barrier positioning machines, the barrier has a body comprising a skirt section, an intermediate section, a shoulder extending upwards from the upper portion of the intermediate section, a trap portion extending upwards from the shoulder, a neck extending upwards from the trap portion, and a head section above the neck.

The shoulder has a negative slope. The trap portion extends upwards from the shoulder and has a positive slope.

The intermediate section comprises a lower portion, a central portion, and an upper portion. The lower portion extends upwards from the skirt section. The central portion extends upwards from the lower portion. The upper portion extends upwards from the central portion. The lower portion has a positive slope with an angle greater than the slope of the skirt. The upper portion has a negative slope.

The body has a first end and an opposite second end. A vertical end channel is formed on each of the first and second ends. In one embodiment, the body is made of cast concrete. A lower tension bar made of steel or similar metal has a lower first tab on one end and a lower second tab on its opposite end. The lower tension bar is located within the skirt section. The lower first tab extends through the channel of the first end. The lower second tab extends through the channel of the second end.

An upper tension bar made of steel or similar metal has an upper first tab on one end and an upper second tab on its opposite end. The upper tension bar is located within the head section. The upper first tab extends through the channel of the first end. The upper second tab extends through the channel of the second end.

The upper and lower first tabs are pivotally connectable to the upper and lower second tabs on an adjacent barrier. The head, trap and neck sections permit highway barrier positioning machines to secure and lift the traffic barrier.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Figure 1:
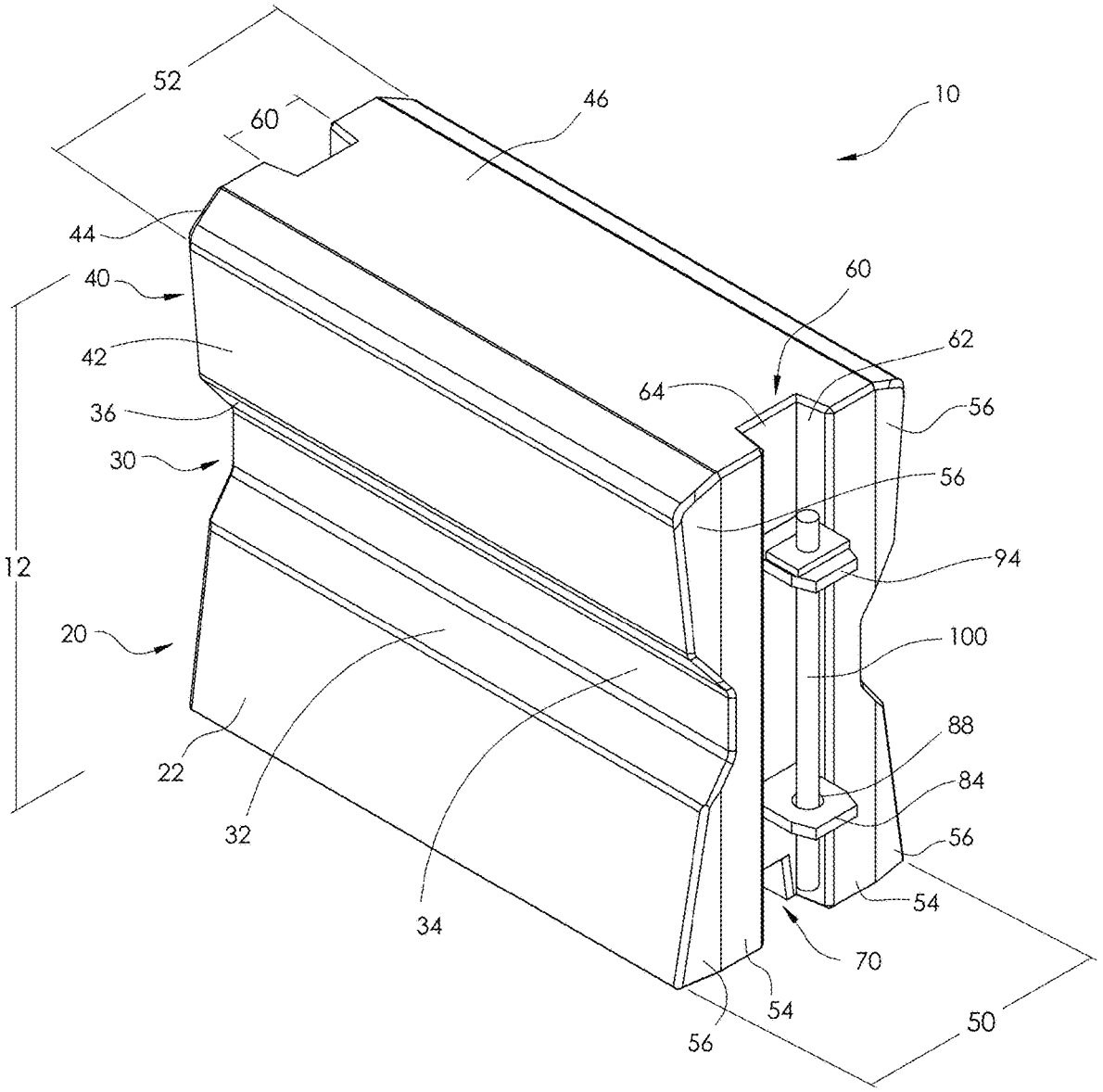
FIG. 1 is a perspective view of a barrier section, according to one embodiment.

FIG. 1 is a perspective view of a barrier section and system, according to one embodiment.

A series connectable traffic barrier 10 is disclosed. Barrier 10 has body 12 comprising a skirt section 20, an intermediate section 30, and a head section 40. Skirt section 20 has an external face 22 having a positive slope. Intermediate section 30 comprises a lower portion 32, a central portion 34, and an upper portion 36. Lower portion 32 extends upwards from skirt section 20 and has a positive slope. Central portion 34 extends upwards from lower portion 32 and has a generally neutral slope. Upper portion 36 extends upwards from central portion 34 and has a negative slope. Head section 40 is located above upper portion 36. Head section 40 has a top surface 46 and an external face 42 having a negative slope. In one embodiment, a pair of top chamfers 44 extend laterally along the top of head section 40 from first end 50 to the second end 52 of body 12.

Body 12 has a first end 50 and an opposite second end 52. Vertical faces 54 are formed on each of first end 50 and second end 52. A vertical end channel 60 is formed on each of first and second ends 50 and 52, between vertical faces 54. In one embodiment, end channels 60 are comprised of a back wall 64 and side walls 62.

In one embodiment, vertical end chamfers 56 are formed on the outermost portions of each of first end 50 and second end 52. In one embodiment, end chamfers 56 intersect skirt section 20 and head section 40. In another embodiment, as shown in FIG. 1, end chamfers 56 intersect skirt section 20, lower portion 32 of intermediate section 30, upper portion 36 of intermediate section 30, and head section 40.

In one embodiment, a bottom channel 70 is formed along the length of skirt section 20, and extends between vertical channels 60 on first end 50 and second end 52. In one embodiment best seen in FIG. 2, bottom channel 70 has a top wall 74 and side walls 72.

Figure 6:
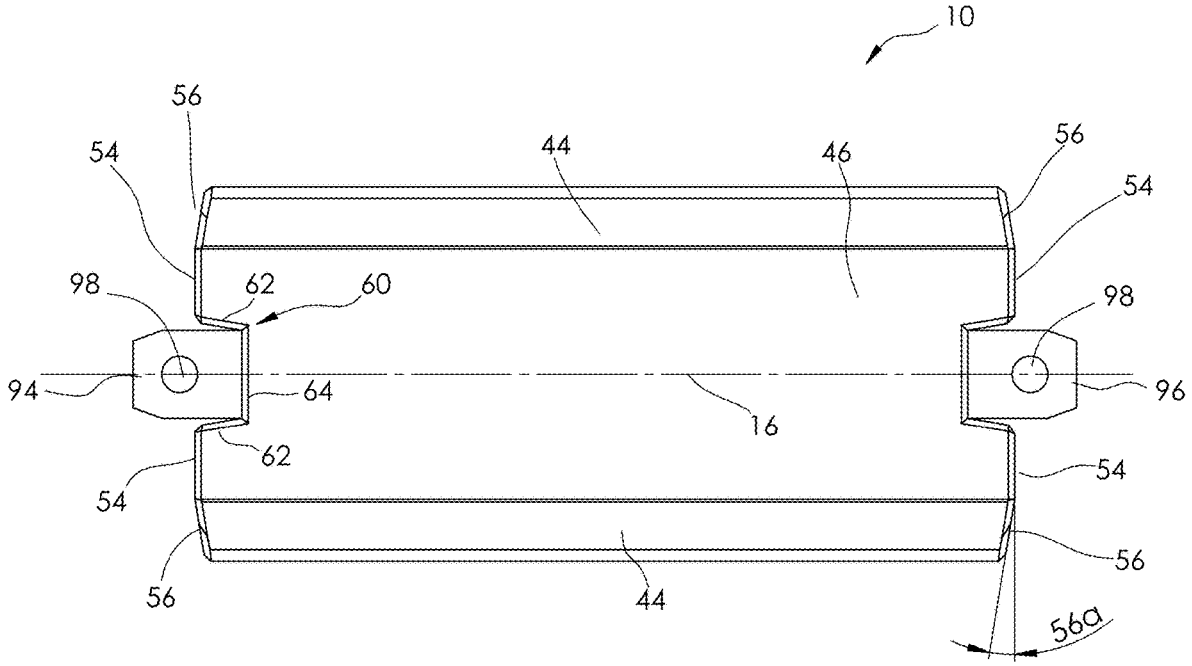
FIG. 6 is a top view of a barrier section, according to the embodiment of FIGS. 1-3.
Figure 7:
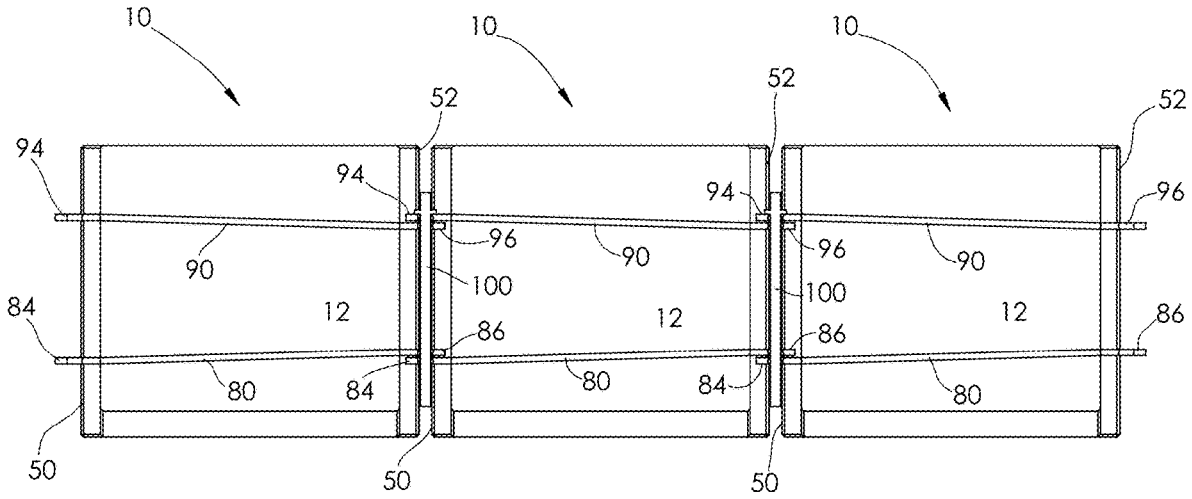
FIG. 7 is a half-section side view of a plurality of connected barrier sections.

As best seen in FIG. 7, body 12 of barrier 10 has as pair of tension bars 80 and 90 cast in it. A lower tension bar 80 is cast in skirt section 20. An upper tension bar 90 is cast in head section 40. Referring back to FIG. 1, lower tension bar 80 has a first tab 84 that extends out of body 12, and into end channel 60 of first end 50. Upper tension bar 90 has a first tab 94 that extends out of body 12, and into end channel 60 of first end 50. As best seen in FIGS. 6 and 7, lower tension bar 80 has a second tab 86 that extends out of body 12, and into end channel 60 of second end 52. Upper tension bar 90 has a second tab 96 that extends out of body 12, and into channel 60 of second end 52.

A pin 100 is locatable in apertures 98 (see FIG. 6) and apertures 88 to pivotally connect barrier section 10 to an adjacent barrier section 10.

Figure 2:
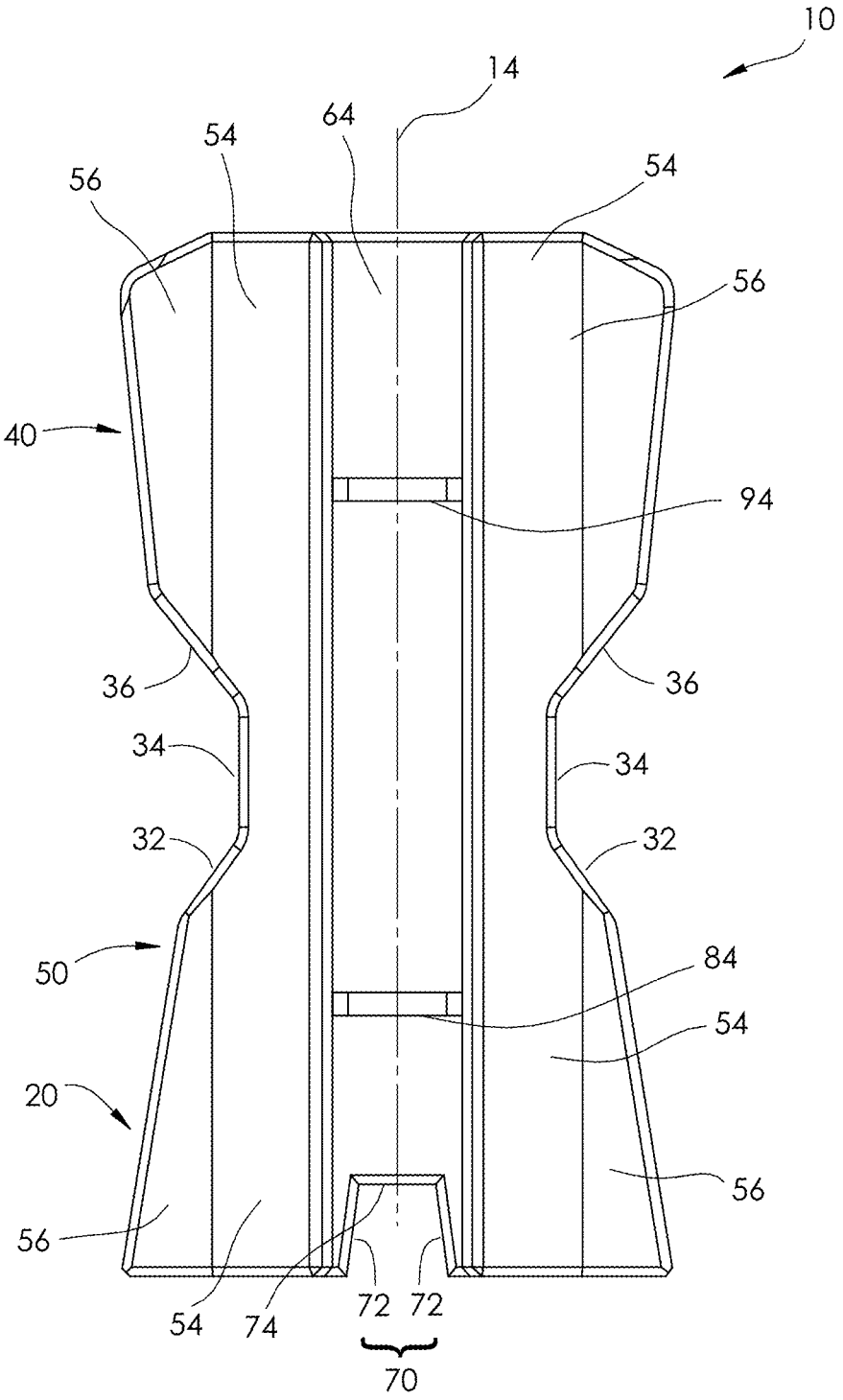
FIG. 2 is an end view of the embodiment of the barrier section illustrated in FIG. 1.
Figure 3:
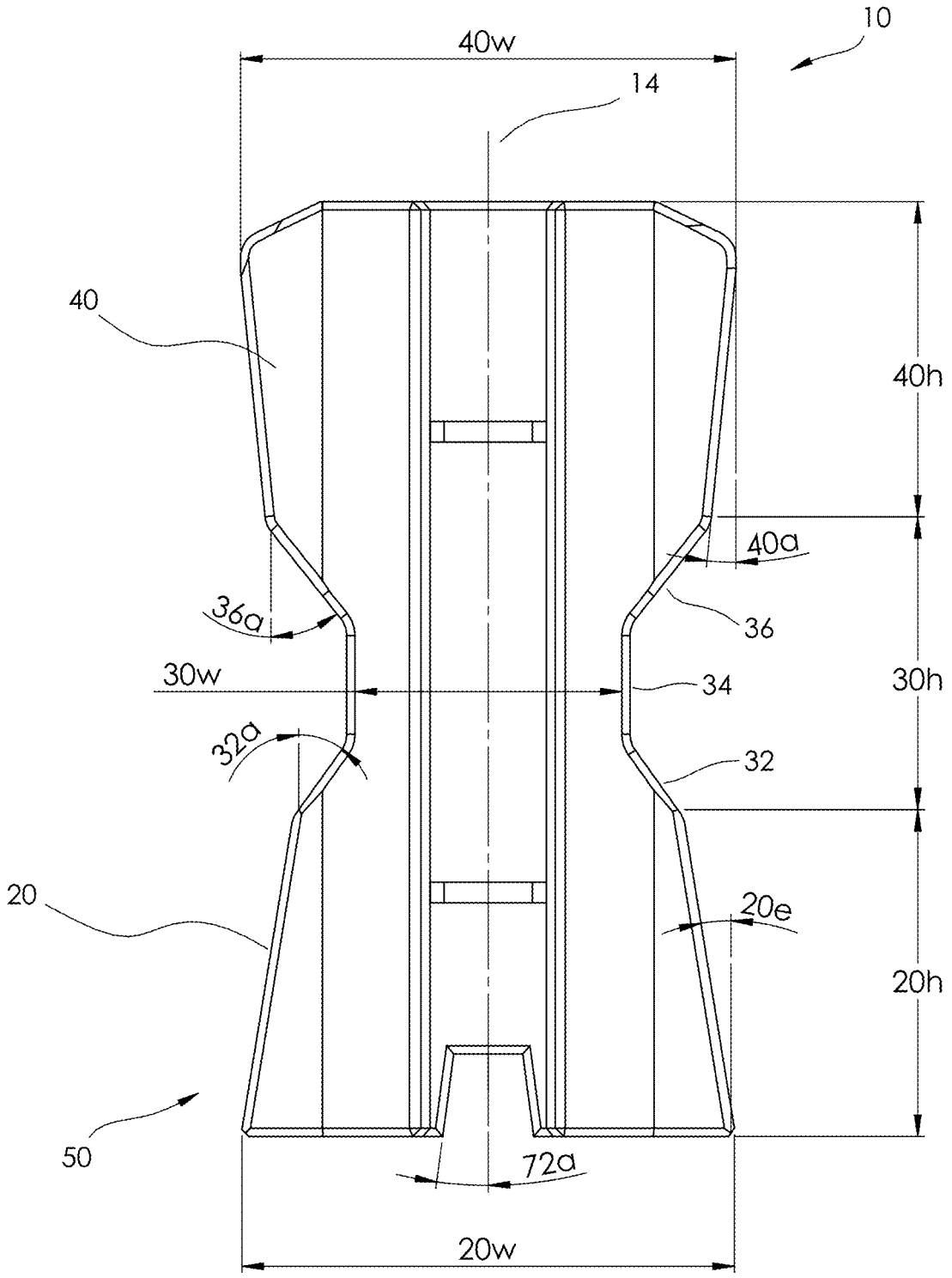
FIG. 3 is another end view of the barrier section, showing additional element features and relationships of the barrier section of FIG. 1.

FIG. 2 is an end view of the embodiment of the barrier section 10 illustrated in FIG. 1. This view illustrates first end 50. Body 12 has a vertical centerline 14 about which barrier section 10 is symmetrical in the embodiment illustrated. Also in the embodiment illustrated in this view, bottom channel 70 has a top wall 74 and side walls 72. As illustrated, side walls 72 converge to centerline 14. Referring to FIG. 3, side walls 72 have an angle 72*a* to centerline 14. In the embodiment illustrated, side walls 72 have a positive slope relative to centerline 14 of body 12, at a small angle in the range of from about 0° to about 5°.

However, in an alternative embodiment (not shown), side walls 72 have a negative slope relative to centerline 14 of body 12, at a small angle in the range of from about 0° to about −5°. Bottom channel 70 can provide a receiving channel for railing fixed to road works. In such instances, it has been determined that divergence of side walls 72 from centerline 14 can provide additional resistance to disengagement of barrier section 10 from the railing.

FIG. 3 is another end view of the embodiment of the barrier section 10 illustrated in FIGS. 1 and 2. This view also illustrates first end 50. The design of this embodiment is the result of extensive computer simulation, design iterations and modifications, and crash testing. Barrier 10 vertical centerline 14 is the reference used by which the barrier 10 profile slope angles are indicated. A slope has a direction running from its lowest vertical point to its highest vertical point. A positive slope is defined as a slope having a direction that runs inwards towards the vertical centerline. A negative slope is defined as a slope having a direction that runs outwards away from the vertical centerline. A neutral slope is defined as a slope that runs substantially vertically (not inwards or outwards) and is thus parallel to the vertical centerline.

As seen in FIG. 3, skirt section 20 has positive slope angle 20*a*. In this embodiment, the skirt section has a positive slope angle 20*a* to centerline 14 in the range of from about 6° to about 14°. Positive slope angle 20*a* creates an uplift of a vehicle during initial impact of a vehicle bumper with barrier section 10. This allows the barrier section 10 to consume energy from vehicular impact (transferring kinetic energy (moving vehicle) to potential energy (lifting of the vehicle's mass along the barrier section 10)).

Lower portion 32 of intermediate section 30 has a positive slope 32*a*. In this embodiment, lower portion 32 has a positive slope angle 32*a* to centerline 14 in the range of from about 16° to about 24°. In one embodiment, lower portion 32 of the intermediate section 30 has a positive slope with a slope angle 32*a* greater than slope angle 20*a* of skirt section 20.

In this embodiment, central portion 34 of intermediate section 30 has a slope angle to centerline 14 in the range of from about −4° to about +4°. This is considered a neutral slope. In this embodiment, upper portion 36 of intermediate section 30 has a negative slope angle 36*a* to centerline 14 in the range of from about −16° to about −24°.

Intermediate section 30 thus comprises a positive slope section 32, a vertical section 34 and a negative slope section 36. This results in an engagement and capturing section allowing the vehicle, once impact has occurred, to continue to engage with the barrier section and creating frictional interaction which consumes and/or dissipates impact energy of the vehicle through friction with the barrier section 10. Intermediary section 30 further stabilizes the vehicle by increasing the time the vehicle stays in contact with barrier section 10, further increasing the amount of impact energy consumed by friction of a vehicle with the barrier section 10.

In this embodiment, head section 40 has a negative slope angle 40*a* to centerline 14 in the range of from about −6° to about −14°. In one embodiment, head section 40 has a negative slope with an angle 40*a* less than the slope angle 36*a* of upper portion 36. The central portion may have a neutral slope.

The negative slope angle 40*a* of head section 40 deforms the body sheet metal of a vehicle during impact into the barrier section 10, consumes impact energy and also causes a downward force on the vehicle, increasing stability of the vehicle and minimizing "ride-up" or override of the vehicle in relation to barrier 10. Ride-up occurs when the impacting vehicle rises to an unstable height on top of a barrier design. If the vehicle is extremely unstable and rides over the barrier, this is defined as override.

Head section 40 has a head width 40*w*. Skirt section 20 has a skirt width 20*w*. In one embodiment, head width 40*w* is within 2" of skirt width 20*w*. This permits center of mass balance of barrier 10, which, when combined with the connection of flat tension bars 80 and 90 of adjacent barriers 10, resists roll-over on impact.

In one embodiment, head section 40 of barrier section 10 has an outermost width 40*w* equal to an outermost width 20*w* of skirt section 20 of barrier section 10. In another embodiment, barrier section 10 has an outmost width to overall height ratio of about 6 to about 11. In another embodiment, the overall length of barrier section 10 may be from about 3 feet to about 33 feet. In another embodiment, the overall height of barrier section 10 may be from about 2.6 feet to about 3.5 feet.

In another embodiment, not illustrated, a rectangular platform is formed below skirt section 20 to raise barrier 10 upwards for anticipated engagement with larger vehicles in selected environments. In this embodiment, the rectilinear platform may be up to 4 inches tall.

The disclosed unique combination of slope angles and heights that comprise the profile of barrier section 10 are essential to the success of barrier section 10 in achieving several safety goals, including absorbing the impact of vehicles impacting barrier 10, minimizing the risks of underride, override, uncontrolled deflection of impacting vehicles while safely absorbing energy within intermediate section 30 to substantially reduce the uncontrolled vehicles' speed.

Figure 12:
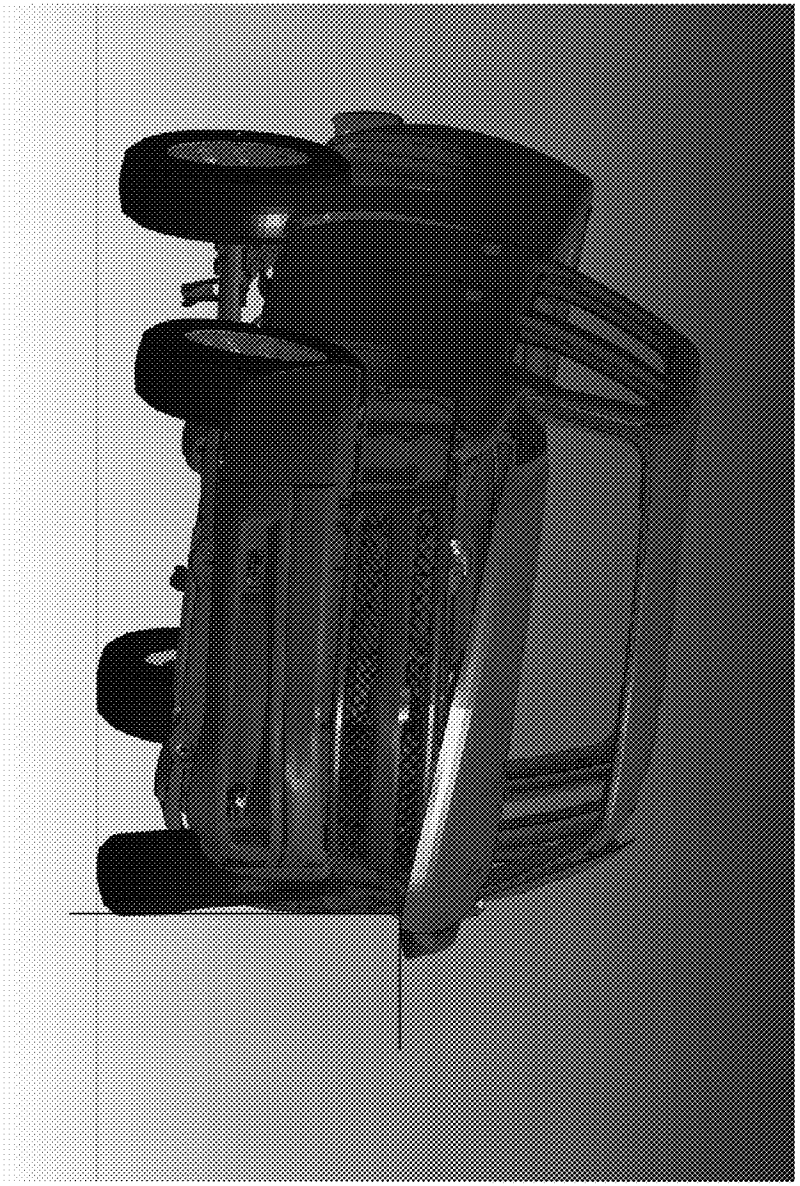
FIG. 12 is a screen shot of a computer model of a vehicle engagement with a vertical barrier.
Figure 13:
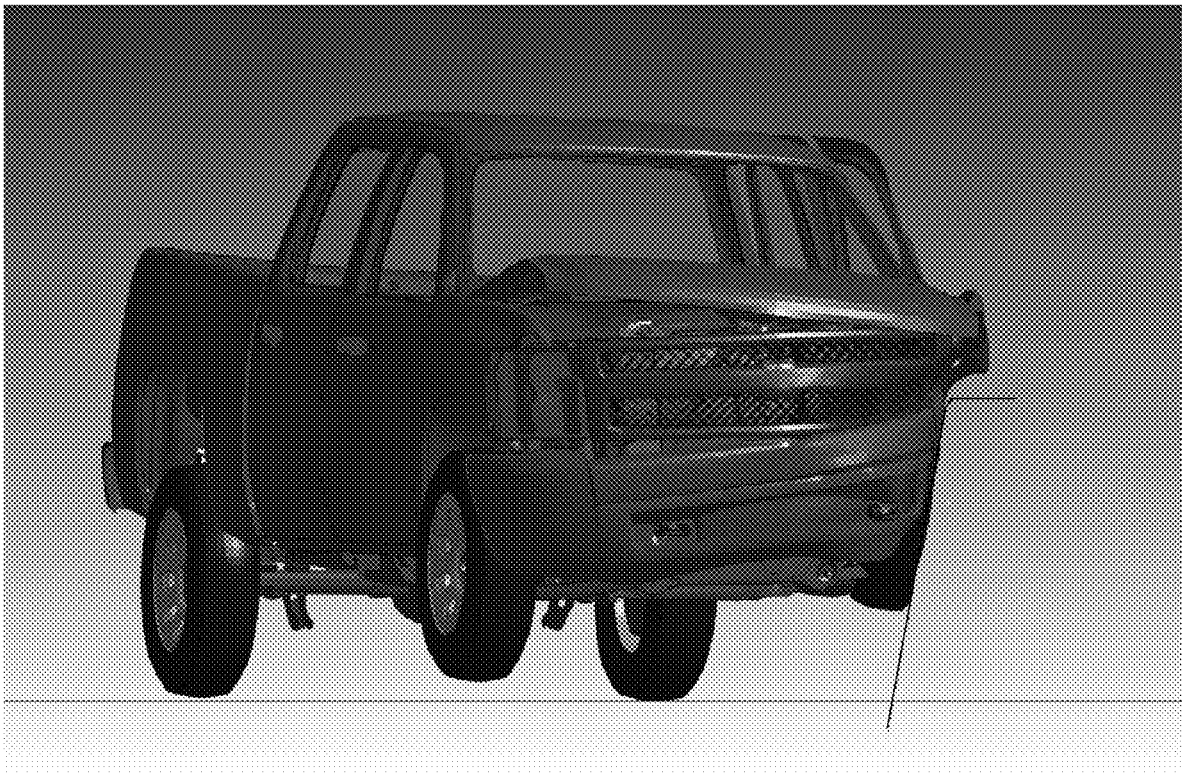
FIG. 13 is a screen shot of a computer model of a vehicle engagement with a single slope barrier.
Figure 14:
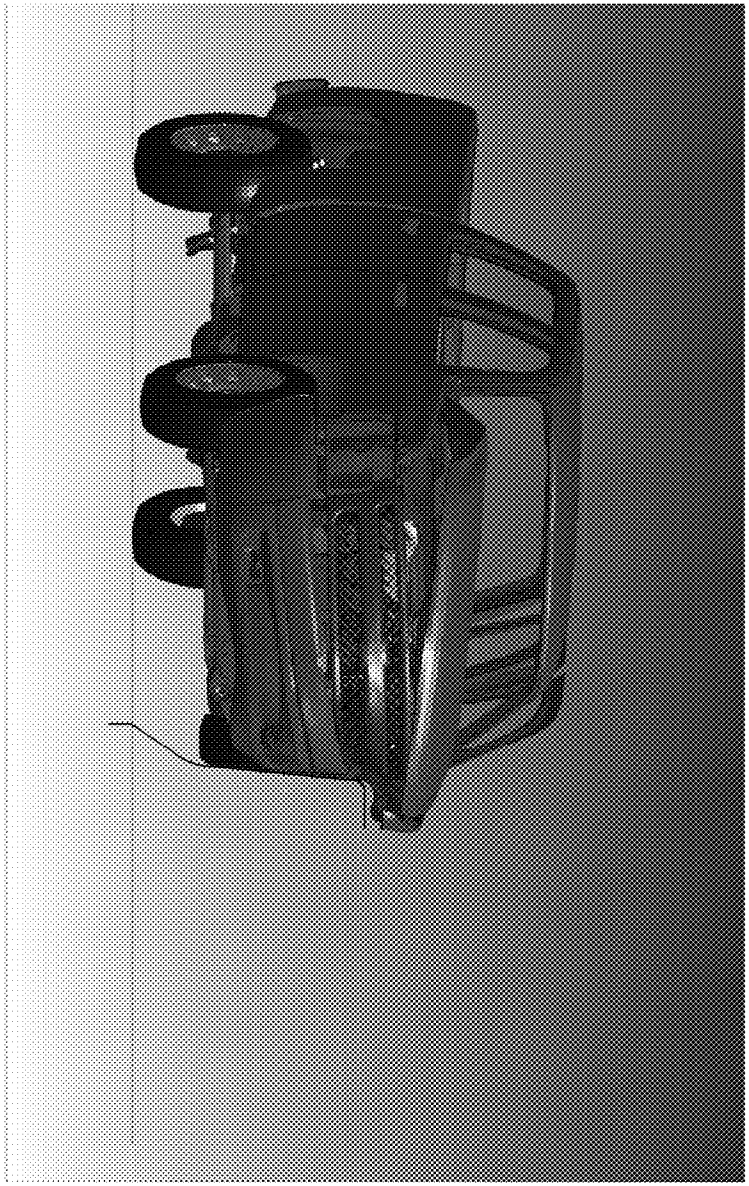
FIG. 14 is a screen shot of a computer model of a vehicle engagement with a modified double slope barrier.
Figure 15:
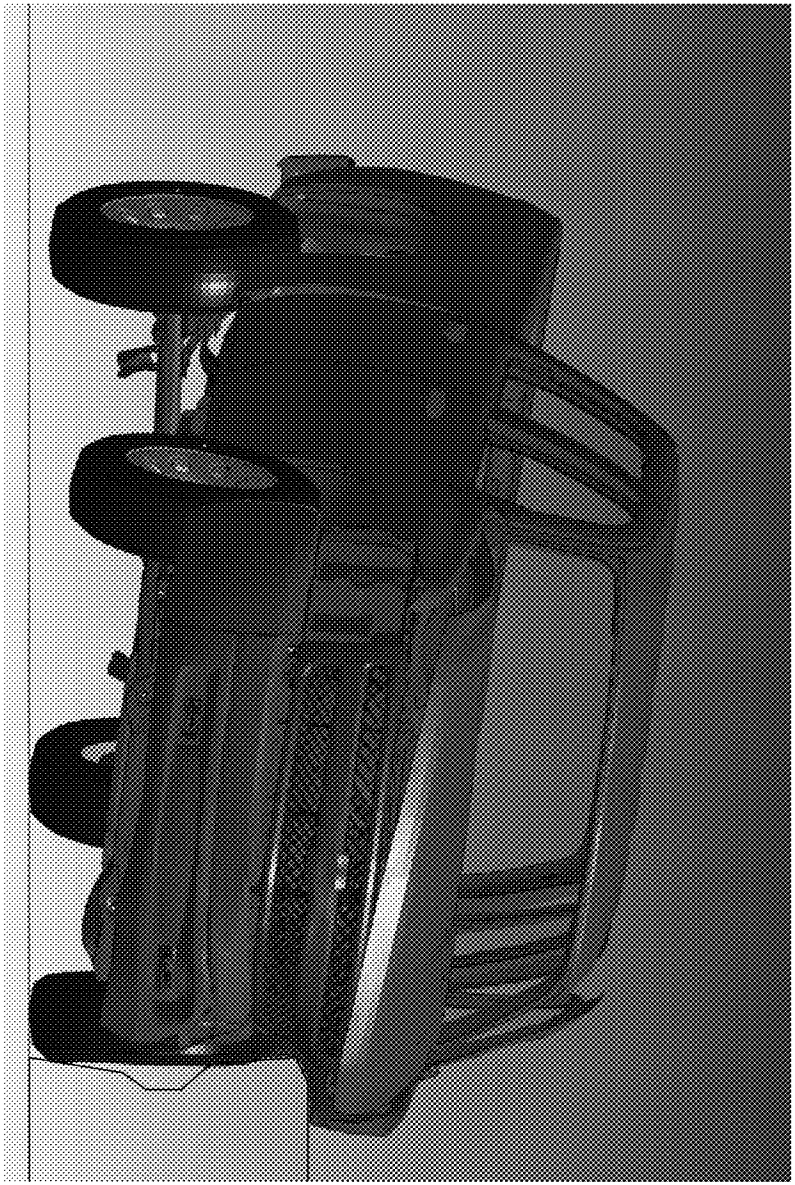
FIG. 15 is a screen shot of a computer model of a vehicle engagement with a barrier having profile features in accordance with one embodiment of the invention.

An example of the performance benefit of the disclosed design is provided in FIGS. 12-15. FIGS. 12-15 are screen shots of computer modeled crash tests demonstrating the capture and control capability of the newly disclosed barrier 10 as compared to conventional barriers. All images are at 1.00 secs into impact. FIG. 12 illustrates vehicle engagement with a vertical barrier. FIG. 13 illustrates vehicle engagement with a single slope barrier. FIG. 14 illustrates vehicle engagement with a modified double slope barrier. FIG. 15 illustrates vehicle engagement barrier 10 having the more complex profile disclosed and claimed herein. As can be seen in the images, only the fourth image (FIG. 15) illustrates capturing the vehicle front end and preventing it from rising dangerously high and risking rollover. While the vertical barrier in FIG. 12 limits the rollover potential, the damage to the vehicle in this design is extensive.

Table 7.1 below demonstrates the success of barrier 10 in actual MASH (Manual for Assessing Safety Hardware) testing on a 1,100 kg compact car (Kia Rio) performed by the Texas A&M Transportation Institute.

TABLE 7.1

Performance Evaluation Summary for MASH Test 3-10 on Flux Barrier.

| Test Agency: Texas A&M Transportation Institute<br>MASH Test 3-10 Evaluation Criteria | Test No.: 690902-PCL4<br>Test Results | Test Date: Nov. 13, 2018<br>Assessment |
|---|---|---|
| Structural Adequacy | | |
| A. Test article should contain and redirect the vehicle or bring the vehicle to a controlled stop; the vehicle should not penetrate, underride, or override the installation although controlled lateral deflection of the test article is acceptable. | The Flux Barrier contained and redirected the 1100 C vehicle. The vehicle did not penetrate, underride, or override the installation. Maximum dynamic deflection during the test was 41.2 inches (1047 mm). | Pass |
| Occupant Risk | | |
| D. Detached elements, fragments, or other debris from the test article should not penetrate or show potential for penetrating the occupant compartment, or present an undue hazard to other traffic, pedestrians, or personnel in a work zone. | No detached elements, fragments, or other debris was present to penetrate to or show potential for penetrating the occupant compartment, or to present hazard to others in the area. | Pass |
| Deformations of, or instructions into, the occupant compartment should not exceed limits set forth in Section 5.2.2 and Appendix E of MASH. | No occupant compartment deformation or intrusion occurred. | |
| F. The vehicle should remain upright during and after collision. The maximum roll and pitch angles are not to exceed 75 degrees. | The 1100 C vehicle remained upright during and after the collision event. Maximum roll and pitch angles were 8° and 4°, respectively. | Pass |
| H. Occupant impact velocities (OIV) should satisfy the following limits: Preferred value of 30 ft/s, or maximum allowable value of 40 ft/s. | Longitudinal OIV was 22.3 ft/s (6.8 m/s), and lateral OIV was 24.9 ft/s (7.6 m/s). | Pass |
| I. The occupant ridedown accelerations should satisfy the following limits: Preferred value of 15.0 g, or maximum allowable value of 20.49 g. | Maximum longitudinal occupant ridedown accelerations was 11.7 g, and maximum lateral occupant ridedown acceleration was 16.6 g. | Pass |
| Vehicle Trajectory | | |
| For redirective devices, it is preferable that the vehicle be smoothly redirected and leave the barrier within the "exit box" criteria (not less than 32.8 ft (10 m) for the 1100 C vehicle), and should be documented. | The 1100 C vehicle exited within the exit box. | Documentation Only |

Table 7.2 below demonstrates the success of barrier 10 in MASH test on a 2,270 kg pick-up truck (Ram Quad Cab) performed by the Texas A&M Transportation Institute.

TABLE 7.2

| Performance Evaluation Summary for MASH Test 3-11 on Flux Barrier. | | |
|---|---|---|
| Test Agency: Texas A&M Transportation Institute<br>MASH Test 3-11 Evaluation Criteria | Test No.: 690902-PCL5<br>Test Results | Test Date: Nov. 8, 2018<br>Assessment |
| Structural Adequacy | | |
| A. Test article should contain and redirect the vehicle or bring the vehicle to a controlled stop; the vehicle should not penetrate, underride, or override the installation although controlled lateral deflection of the test article is acceptable. | The Flux Barrier contained and redirected the 2270 P vehicle. The vehicle did not penetrate, underride, or override the installation. Maximum dynamic deflection during the test was 62.7 inches (1593 mm). | Pass |
| Occupant Risk | | |
| D. Detached elements, fragments, or other debris from the test article should not penetrate or show potential for penetrating the occupant compartment, or present an undue hazard to other traffic, pedestrians, or personnel in a work zone. | No detached elements, fragments, or other debris was present to penetrate to or show potential for penetrating the occupant compartment, or to present hazard to others in the area. | Pass |
| Deformations of, or instructions into, the occupant compartment should not exceed limits set forth in Section 5.2.2 and Appendix E of MASH. | No occupant compartment deformation or intrusion occurred. | |
| F. The vehicle should remain upright during and after collision. The maximum roll and pitch angles are not to exceed 75 degrees. | The 2270 P vehicle remained upright during and after the collision event. Maximum roll and pitch angles were 14° and 5°, respectively. | Pass |
| H. Occupant impact velocities (OIV) should satisfy the following limits: Preferred value of 30 ft/s, or maximum allowable value of 40 ft/s. | Longitudinal OIV was 18.4 ft/s (5.6 m/s), and lateral OIV was 19.4 ft/s (5.9 m/s). | Pass |
| I. The occupant ridedown accelerations should satisfy the following limits: Preferred value of 15.0 g, or maximum allowable value of 20.49 g. | Maximum longitudinal occupant ridedown accelerations was 7.7 g, and maximum lateral occupant ridedown acceleration was 7.6 g. | Pass |
| Vehicle Trajectory | | |
| For redirective devices, it is preferable that the vehicle be smoothly redirected and leave the barrier within the "exit box" criteria (not less than 32.8 ft (10 m) for the 2270 P vehicle), and should be documented. | The 2270 P vehicle exited within the exit box. | Documentation Only |

As seen from the test results, the unique profile of barrier 10 disclosed herein combined with its unique construction features provides a safe traffic barrier system for vehicles of very different sizes.

Figure 4:
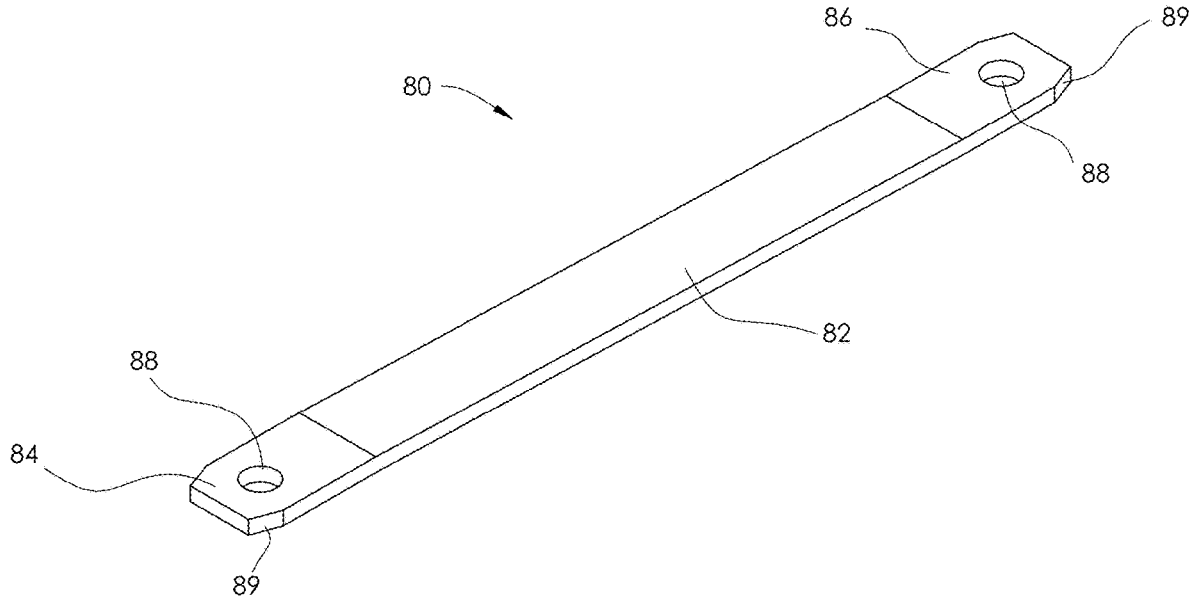
FIG. 4 is a perspective view of a tension bar, according to one embodiment.

FIG. 4 is a perspective view of a lower tension bar 80, according to one embodiment. Although lower tension bar 80 and upper tension bar 90 are numbered separately, they are identical in structure and interchangeable. As seen in FIG. 4, lower tension bar 80 is an elongated flat bar. Lower tension bar 80 has a central inclined portion 82. A lower first tab 84 and a lower second tab 86 are located on opposite ends of inclined portion 82. Apertures 88 are located on each of lower first tab 84 and lower second tab 86 for receiving pins 100. A chamfered edge 89 may be provided on each of lower first tab 84 and lower second tab 86.

Figure 5:
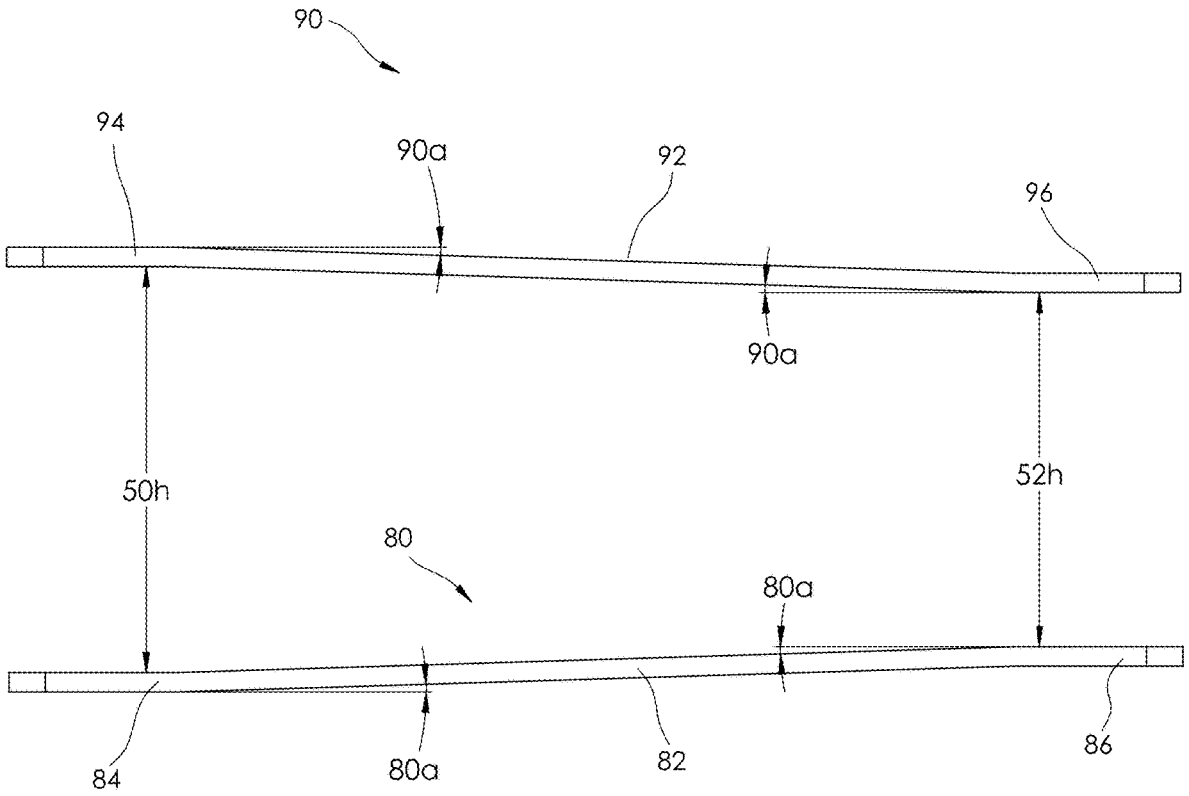
FIG. 5 is a side view of upper and lower tension bars, shown in their relative positions within the barrier of the embodiment of FIG. 1.

FIG. 5 is a side view of upper tension bar 90 and lower tension bar 80, illustrated in their relative positions within barrier 10. Upper and lower tension bars 90 and 80 are made of steel or other alloy with the property of high tensile strength. As seen in this view, inclined portion 82 is angled in the amount of angle 80*a* as between each of lower first tab 84 and lower second tab 86. In one embodiment, angle 80*a* is between about 1° and 3°. Similarly inclined portion 92 is angled in the amount of angle 90*a* as between each of upper first tab 94 and upper second tab 96. The difference between upper and lower tension bars 90 and 80 is their relative orientation, as they are otherwise identical.

Upper first tab 94 and lower first tab 84 extend outside of body 12 as seen in FIG. 1. Upper first tab 94 and lower first tab 84 are separated at first end 50 by a distance 50*h*. Upper second tab 96 and lower second tab 86 extend outside of body 12 at second end 52. Upper second tab 96 and lower second tab 86 are separated at second end 52 by a distance 52*h*. As seen in FIG. 5, length 50*h* is greater than length 52*h*.

FIG. 6 is a top view of barrier section 10, according to the embodiment of FIGS. 1-3. Barrier 10 has a lateral centerline 16. Upper and lower tension bars 90 and 80 are centered on lateral centerline 16. In this manner, apertures 98 and 88 on both ends of upper and lower tension bars 90 and 80 are vertically and horizontally aligned for receiving a pin 100 through the aligned apertures 98 of the upper and lower first tabs 94 and 84 on one barrier 10 and through the apertures 88 of the upper and lower second tabs 96 and 86 on an adjacent barrier 10 (see FIG. 7).

As seen in FIG. 6, end chamfers 56 have an angle to vertical faces 54 of 56*a*. End chamfers 56 both facilitate and limit articulation between connected adjacent barrier sections 10. In one embodiment, angle 56*a* ranges from about 10° to about 20°.

FIG. 7 is a half-section side view of a plurality of series connected barrier sections 10. Lower tension bar 80 is located within skirt section 20 of body 12. Lower first tab 84 extends into channel 60 of the first end 50. Lower second tab 86 extends into channel 60 of second end 52. Both lower first tab 84 and lower second tab 86 extend horizontally into channels 60.

Upper tension bar 90 is located within head section 40 of body 12. Upper first tab 94 extends into channel 60 of the first end 50. Upper second tab 96 extends into channel 60 of second end 52. The extension of upper first tab 94 and upper second tab 96 into channels 60 is horizontal. Referring back to FIG. 5, only inclined portions 82 and 92 are angularly disposed.

Upper tension bar 90 is inclined downwards inside head section 40 between upper first tab 94 and the upper second tab 96. Lower tension bar 80 is oppositely inclined upwards inside skirt 20 between lower first tab 84 and the lower second tab 86. This permits upper and lower second tabs 96 and 86 of a first barrier section 10 to be positioned between upper and lower first tabs 94 and 84 on an adjacent barrier 10. A pivot pin 100 is insertable through apertures 98 and 88 on upper and lower second tabs 96 and 86 of first barrier section 10 and through upper and lower first tabs 94 and 84 of adjacent barrier 10. This provides a strong pivotal connection between adjacent barriers 10 that can be readily lifted into and out of a barrier moving machine.

Importantly, the solid, full-length elongated tension bars 80 and 90 resist rotation relative to body 12 on impact, and provide a uniform distribution of tensile stress and elongation across the range of series connected barriers 10 rather than the non-uniform distribution that occurs when end connectors are cast into concrete barriers. Additionally, tension bars 80 and 90 do not rely on any mechanical connection (welding or bolting) that could be damaged in an impact.

Figure 8:
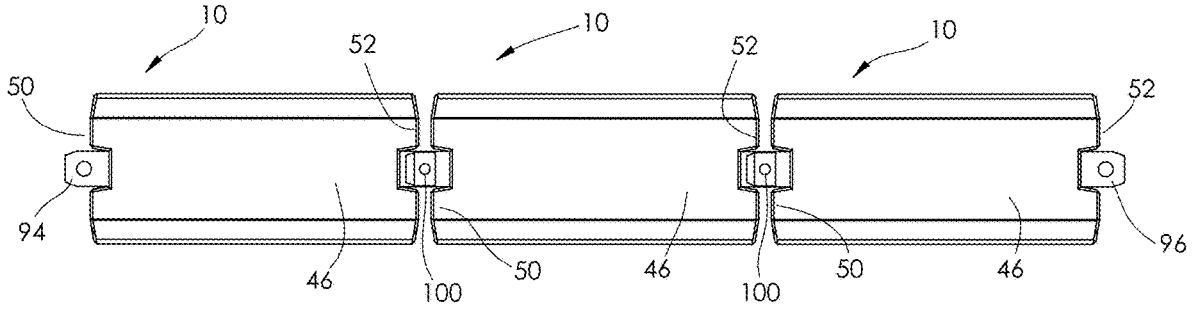
FIG. 8 is a top view of the connected barrier sections illustrated in FIG. 7.

FIG. 8 is a top view of the connected barrier sections 10 illustrated in FIG. 7. In this view, barrier sections 10 are linearly aligned. There is a uniform gap between each first end 50 and each second end 52 of adjacent barrier sections 10. Also in this view, the vertical alignment of upper and lower second tabs 96 and 86 of a first barrier section 10 with upper and lower first tabs 94 and 84 on an adjacent barrier 10 is seen as pivot pin 100 connects adjacent barrier sections 10.

Figure 9:
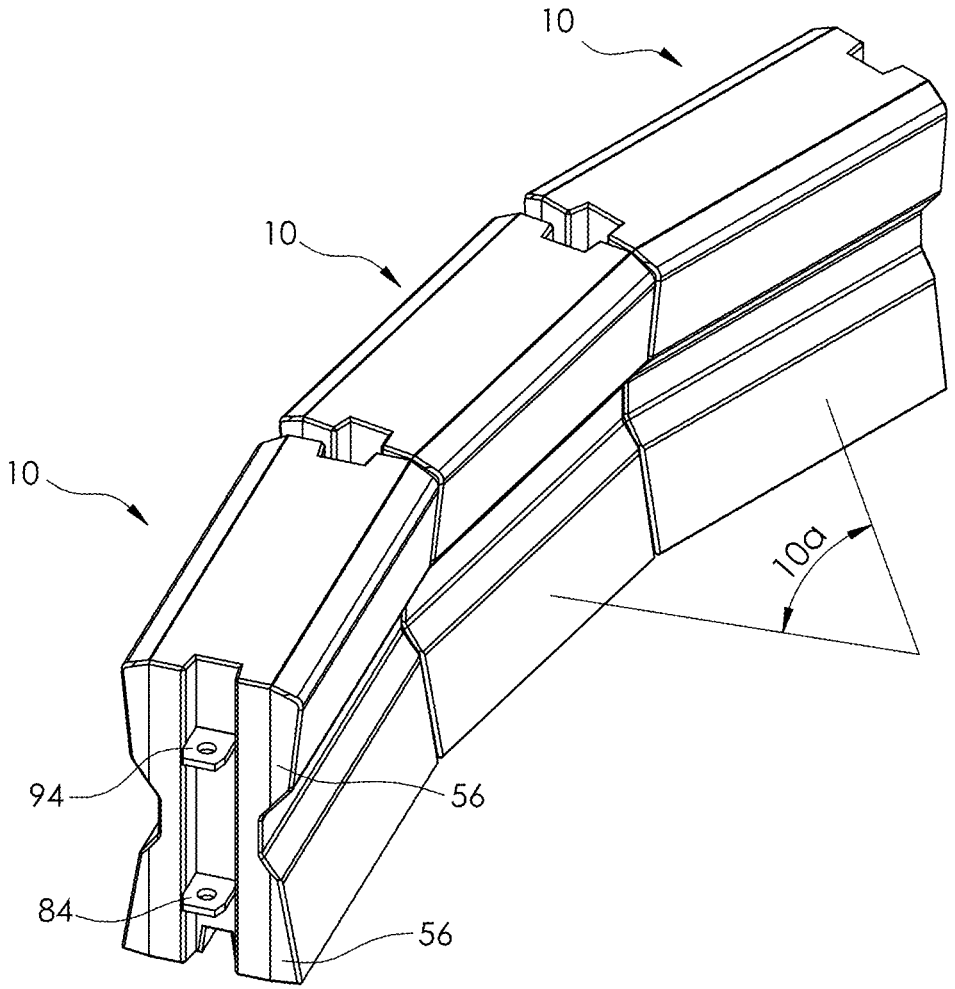
FIG. 9 is a perspective view of the connected barrier sections of FIGS. 7 and 8, illustrating the barrier sections rotated while connected to provide a curved barrier system.

FIG. 9 is a perspective view of the connected barrier sections of FIGS. 7 and 8, illustrating barrier sections 10 rotated while connected to provide a curved barrier system.

Barrier sections 10 are pivotally connected to allow for rotation around the central axis of pin 100. This provides independent movement of one barrier section 10 in relation to an adjacent barrier section 10. In this manner, the connected barrier sections 10 may be configured to form angles and curves to accommodate curves and turns in roadways and to accommodate directing traffic flow as needed.

As shown and detailed herein above, vertical end chamfers 56 are formed on the outermost portion of each of first end 50 and second end 52. End chamfers 56 both facilitate and limit articulation between connected adjacent barrier sections 10. In the embodiment illustrated in FIG. 6, angle 56*a* ranges from about 10° to about 20°. Thus, when fully rotated such that end chamfer 56 abuts end chamfer 56 of adjacent barrier 10 as illustrated in FIG. 9, the adjacent barrier sections 10 meet at angle 10*a*. In this embodiment 10*a* has a maximum angular disposition of about 20° to about 40° and a full range of 0° to about 40°, noting however that angle 10*a* may be achieved on either side of the barriers 10. In this embodiment, when a vehicle impacts the connected barrier sections 10, maximum displacement is limited and the impact stresses are spread over a larger area of the barrier sections 10. This has the further benefit of reducing the likelihood of spalling or deformation of bodies 12 of barrier sections 10.

Figure 10:
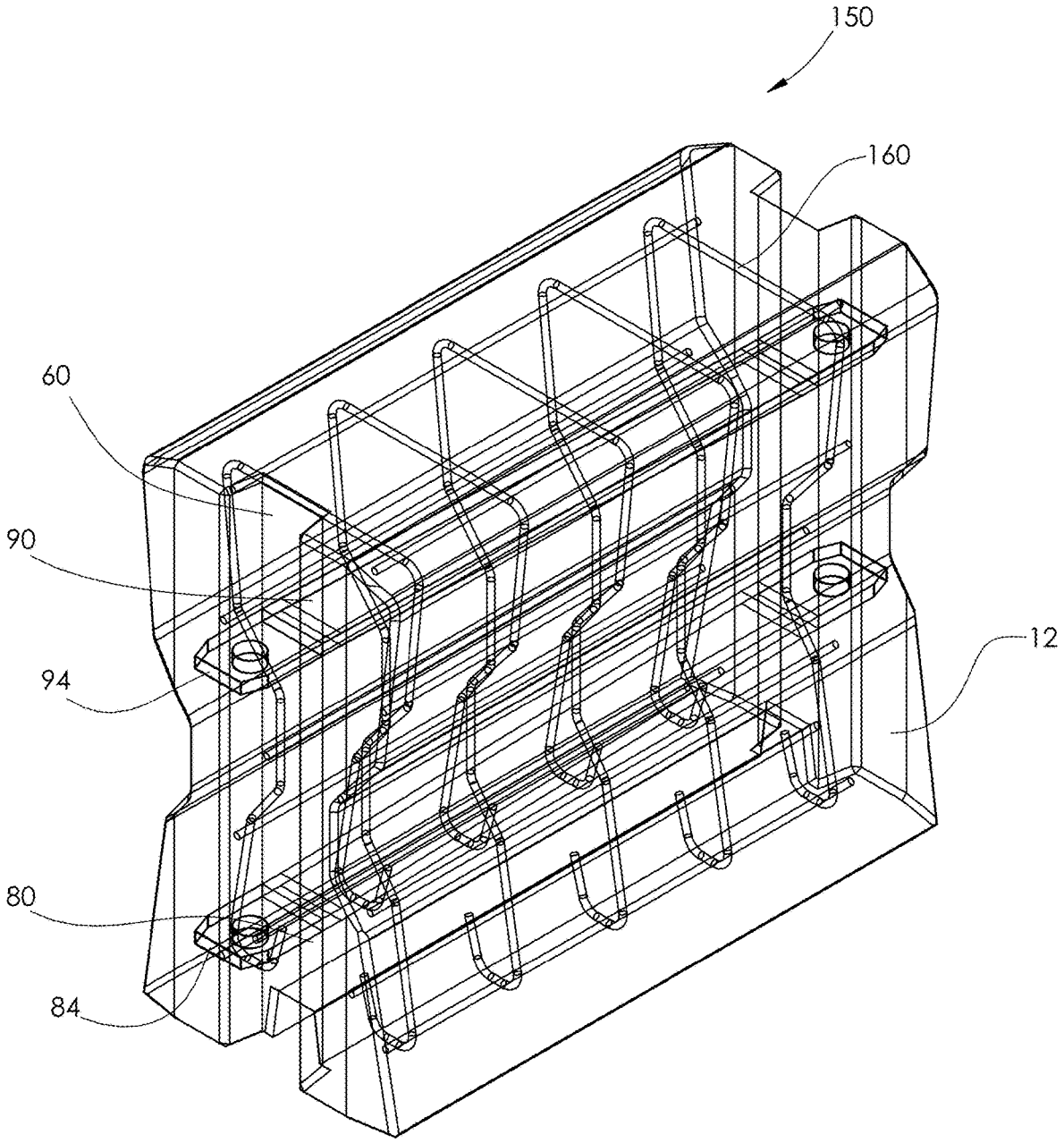
FIG. 10 is a perspective wireframe view of a barrier section in accordance with one embodiment, illustrating the use of reinforcing bars in the manufacture of the barrier section.

FIG. 10 is a perspective wireframe view of a barrier section 150 in accordance with one embodiment, illustrating the use of reinforcing bars 160 in the manufacture.

Barrier section 150 is made of a cast concrete. To support and strengthen barrier section 150 beyond what is provided by tension bars 80 and 90, a strengthening rebar cage 160 can be incorporated into the concrete casting. However, tension bars 80 and 90 can be cast into concrete body 12 of barrier 10 without rebar cage 160 to reduce cost.

Figure 11:
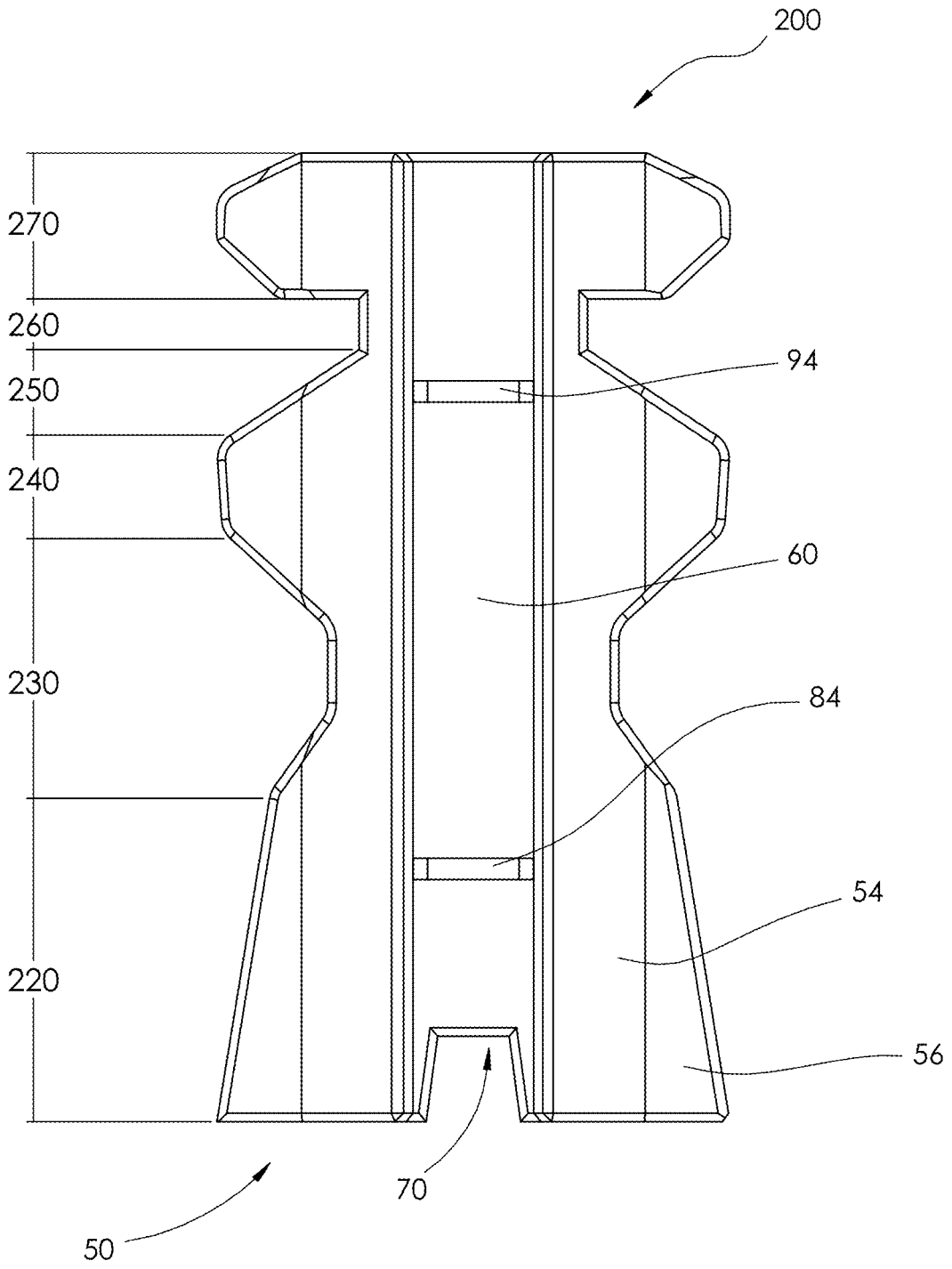
FIG. 11 is an end view of an alternative embodiment of the barrier section.

FIG. 11 is an end view of an alternative embodiment of barrier section 200. This embodiment is provided for use with existing highway barrier positioning machines. Barrier 200 has a body 12 comprising a skirt section 220 and an intermediate section 230. Additionally, barrier 200 has a shoulder section 240 extending above intermediate section 230, a trap section 250 extending above shoulder section 240, and a neck section 260 extending above trap section 250. Head section 270 extends above neck section 260.

In an alternative embodiment designed for use with highway barrier positioning machines, the barrier has a body comprising a skirt section, an intermediate section, a shoulder extending upwards from the upper portion, a trap portion extending upwards from the shoulder, a neck extending upwards from the trap portion, and a head section above the neck.

In this embodiment, shoulder section 240 may have a neutral or slightly negative slope. Trap section 250 has a positive slope. Neck section 260 may have a neutral slope.

The intermediate section comprises a lower portion, central portion, and upper portion, and having slope angles as described above for barrier section 10 (not numbered in this view (see FIG. 2). The lower portion extends upwards from skirt section 220. The central portion extends upwards from the lower portion. The upper portion extends upwards from the central portion. The lower portion has a positive slope with an angle greater than the slope of the skirt. The upper portion has a negative slope.

In this embodiment, neck section 260 formed between trap section 250 and head section 270 allows for holding and lifting of barrier section 200. In one embodiment, the holding and lifting may be accomplished via at least one of a clamp, roller, fork, slides, and combinations thereof (see FIG. 6). Intermediate section 230 functions in the same manner as intermediate section 30 as illustrated in FIGS. 1 and 2.

As used herein, the term "substantially" is intended for construction as meaning "more so than not."

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. A traffic barrier, comprising:

a body, the body comprising:

a skirt section, extending upwards and having a positive slope;

an intermediate section comprising a lower portion that extends upwards from the skirt section, a central portion that extends upwards from the lower portion, and an upper portion that extends upwards from the central portion;

the lower portion having a positive slope having an angle greater than the slope of the skirt;

the upper portion having a negative slope;

a head section above the upper portion;

the head section having a negative slope having an angle less than the slope of the upper portion;

a first end, and an opposite second end; and, a vertical end channel formed on each of the first and second ends;

a lower tension bar located within the skirt section, having a lower first tab extending through the channel of the first end and having a lower second tab extending through the channel of the second end;

an upper tension bar located within the head section, having an upper first tab extending through the channel of the first end and having an upper second tab extending through the channel of the second end; and, the upper first tab and lower first tab of a first traffic barrier being pivotally connectable to the upper second tab and lower second tab of an adjacent second traffic barrier.

2. The barrier section of claim 1, further comprising:

the width of the head section is within 2" of the width of the skirt section.

3. The barrier section of claim 1, further comprising:

a bottom channel extending along the bottom of the skirt from the channel of the first end to the channel of the second end.

4. The barrier section of claim 1, further comprising:

a pair of top chamfers extending horizontally along the top of the head section from the first end to the second end of the body.

5. The barrier section of claim 1, further comprising:

an aperture on the upper first tab;

an aperture on the lower first tab in vertical alignment with the aperture on the upper first tab;

an aperture on the upper second tab; and, an aperture on the lower second tab in vertical alignment with the aperture on the upper second tab.

6. The barrier section of claim 5, further comprising:

the upper and lower second tabs of a first barrier section being locatable between the upper and lower first tabs on an adjacent barrier; and, a pin insertable through the apertures on upper and lower second tabs of the first barrier section and the upper and lower first tabs of the adjacent barrier.

7. The barrier section of claim 6, further comprising:

the upper tension bar being inclined downwards inside the head section between the upper first tab and the upper second tab;

the lower tension bar being inclined upwards inside the skirt between the lower first tab and the lower second tab;

the upper first tab and upper second tab extending horizontally into the channels of the first end and second end, respectively; and, the lower first tab and lower second tab extending horizontally into the channels of the first end and second end, respectively.

8. The barrier section of claim 1, further comprising:

the body having a centerline along its length; and, the upper and lower tension bars being located on the centerline.

9. The barrier section of claim 8, further comprising:

the skirt section having a positive slope angle to the centerline in the range of from about 6° to about 14°.

10. The barrier section of claim 8, further comprising:

the lower portion of the intermediate section having a positive slope angle to the centerline in the range of from about 16° to about 24°.

11. The barrier section of claim 8, further comprising:

the central portion of the intermediate section having an angle to the centerline in the range of from about −4° to about +4°.

12. The barrier section of claim 8, further comprising:

the upper portion of the intermediate section having a negative slope angle to the centerline in the range of from about −16° to about −24°.

13. The barrier section of claim 8, further comprising:

the head section having a negative slope angle to the centerline in the range of from about −6° to about −14°.

14. The barrier section of claim 8, the bottom channel further comprising:

a pair of side walls;

a top wall;

the side walls having a negative slope angle to the centerline in the range of from about 5° to about −5°.

15. The barrier section of claim 1, further comprising:

a pair of vertical chamfered edges formed on each of the first end and second end of the body; and, wherein the chamfered edges allow for an articulated connection between two adjacent connected barrier sections.

16. The barrier section of claim 15, further comprising:

the chamfered edges intersecting the head section and the skirt section.

17. The barrier section of claim 15, further comprising:

the chamfered edges intersecting the head section, the upper portion, the lower portion, and the skirt section.

18. The barrier section of claim 15, further comprising:

the chamfered edges having an angle to the first end and the second end of the body in the ranges of from 10° to about 20°.

19. The barrier section of claim 15, further comprising:

a pair of top chamfers extending horizontally along the top of the head section between the chamfered edges of the first end and the second end of the body.

20. A traffic barrier, comprising:

a body, the body comprising:

a skirt section, extending upwards and having a positive slope;

an intermediate section comprising a lower portion that extends upwards from the skirt section, a central portion that extends upwards from the lower portion, and an upper portion that extends upwards from the central portion;

the lower portion having a positive slope having an angle greater than the slope of the skirt;

the upper portion having a negative slope;

a shoulder extending upwards from the upper portion and having a negative slope;

a trap extending upwards from the shoulder and having a positive slope;

a neck extending upwards from the trap;

a head section above the neck;

a first end, and an opposite second end; and, a vertical end channel formed on each of the first and second ends;

a lower tension bar, within the skirt section, having a lower first tab extending through the channel of the first end and having a lower second tab extending through the channel of the second end;

an upper tension bar within the head section, having an upper first tab extending through the channel of the first end and having an upper second tab extending through the channel of the second end;

the upper first tab and lower first tab of a first traffic barrier being pivotally connectable to the upper second tab and the lower second tab of an adjacent second traffic barrier; and, wherein the head, trap and neck sections permit highway barrier positioning machines to secure and lift the traffic barrier.

21. The barrier section of claim 20, further comprising:

a pair of top chamfers extending horizontally along the top of the head section between the chamfered edges of the first end and the second end of the body.

22. The barrier section of claim 20, further comprising:

an aperture on the upper first tab;

an aperture on the lower first tab in vertical alignment with the aperture on the upper first tab;

an aperture on the upper second tab; and, an aperture on the lower second tab in vertical alignment with the aperture on the upper second tab.

23. The barrier section of claim 20, further comprising:

the upper and lower second tabs of a first barrier section being locatable between the upper and lower first tabs on an adjacent barrier; and, a pin insertable through the apertures on the upper and lower second tabs of the first barrier section and the upper and lower first tabs of the adjacent barrier.

24. The barrier section of claim 20, further comprising:

the upper tension bar being inclined downwards inside the head section between the upper first tab and the upper second tab;

the lower tension bar being inclined upwards inside the skirt between the lower first tab and the lower second tab;

the upper first tab and upper second tab extending horizontally into the channels of the first end and second end, respectively; and, the lower first tab and lower second tab extending horizontally into the channels of the first end and second end, respectively.

25. The barrier section of claim 20, further comprising:

the body having a centerline along its length; and, the upper and lower tension bars being located on the centerline.

26. The barrier section of claim 20, further comprising:

the neck having an angle to a centerline of the body in the range of from about −4° to about +4°.

27. The barrier section of claim 20, further comprising:

the shoulder having a negative slope of a lesser angle than the negative slope of the upper portion.

28. The barrier section of claim 20, further comprising:

the head having a negative sloped portion and a positive sloped portion;

the negative sloped portion of the head having an angle in the range of from about −4° to about +4° of the positive slope of the shoulder.

29. The barrier section of claim 20, further comprising:

the negative slope formed by the head section towards the neck portion and the positive slope formed by the trap towards the neck portion form an angle facilitating holding and lifting of the barrier section.

* * * * *